US007597129B2

(12) United States Patent
Schofield et al.

(10) Patent No.: US 7,597,129 B2
(45) Date of Patent: Oct. 6, 2009

(54) DOOR CLOSURE SYSTEM

(75) Inventors: Christine Isobel Schofield, Hunslet (GB); Peter James Howard Rodgers, Hunslet (GB)

(73) Assignee: Ralph Ellerker (1795) Ltd. (GB)

( * ) Notice: Subject to any disclaimer, the term of this patent is extended or adjusted under 35 U.S.C. 154(b) by 362 days.

(21) Appl. No.: 11/199,485

(22) Filed: Aug. 8, 2005

(65) Prior Publication Data

US 2006/0289497 A1 Dec. 28, 2006

(30) Foreign Application Priority Data

May 16, 2005 (GB) ..... 0509919.7

(51) Int. Cl.
*E06B 7/16* (2006.01)

(52) U.S. Cl. ..... 160/41; 160/44; 454/188

(58) Field of Classification Search ..... 160/41, 160/44, 120, 241, 239; 454/188, 195, 331; 62/256

See application file for complete search history.

(56) References Cited

U.S. PATENT DOCUMENTS 1,806,859 A * 5/1931 Mattei ..... 114/117
3,231,006 A * 1/1966 Fisher et al. ..... 160/41
3,347,145 A * 10/1967 Steelman ..... 454/193
3,753,317 A * 8/1973 Turpin et al. ..... 49/35
3,886,851 A * 6/1975 Berner ..... 454/192
4,151,871 A * 5/1979 Ryan ..... 160/25
4,275,645 A * 6/1981 Ruff ..... 454/188

FOREIGN PATENT DOCUMENTS

GB 2 385 659 A 8/2003

* cited by examiner

*Primary Examiner*—Blair M. Johnson
(74) *Attorney, Agent, or Firm*—Winstead P.C.

(57) ABSTRACT

A door structure, said structure for use particularly, although not necessarily exclusively, to selectively close an opening between a first environment which is at a temperature which is lower than the temperature of the environment on the opposing side of the opening. The door is provided with a structure so as to define a cavity therein into which air is caused to flow. The door has formations and a structure so as to encourage uniform air flow through the cavity and hence prevent or minimise the creation of condensation and/or frost on the door structure.

13 Claims, 4 Drawing Sheets

Figure 1
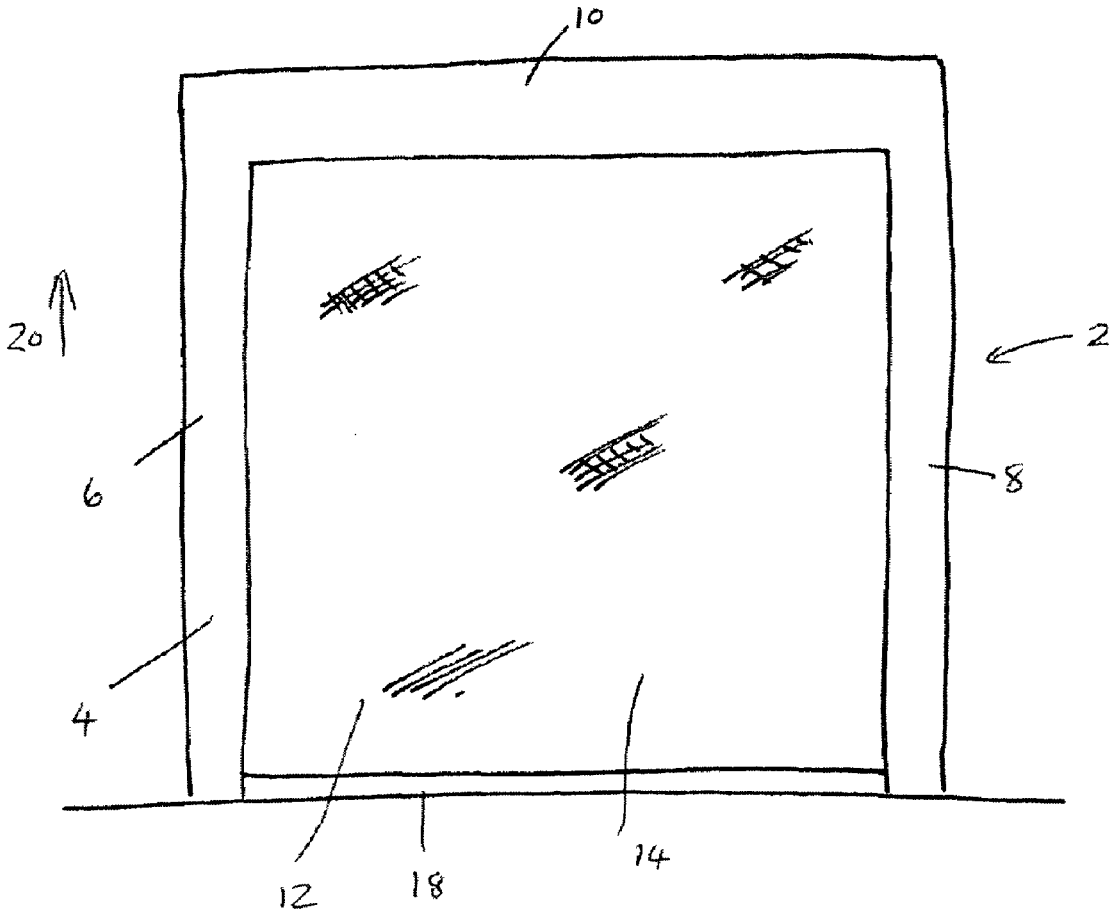
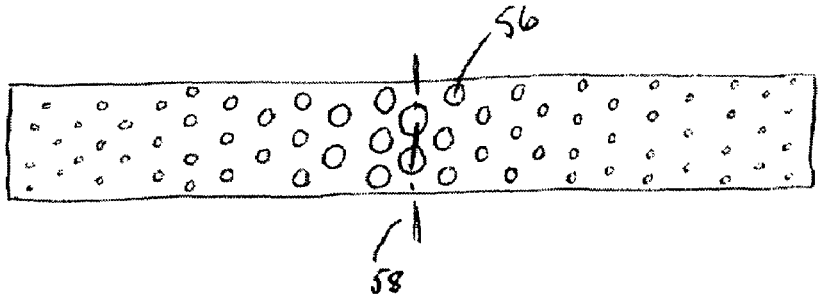
Figure 6

Figure 2
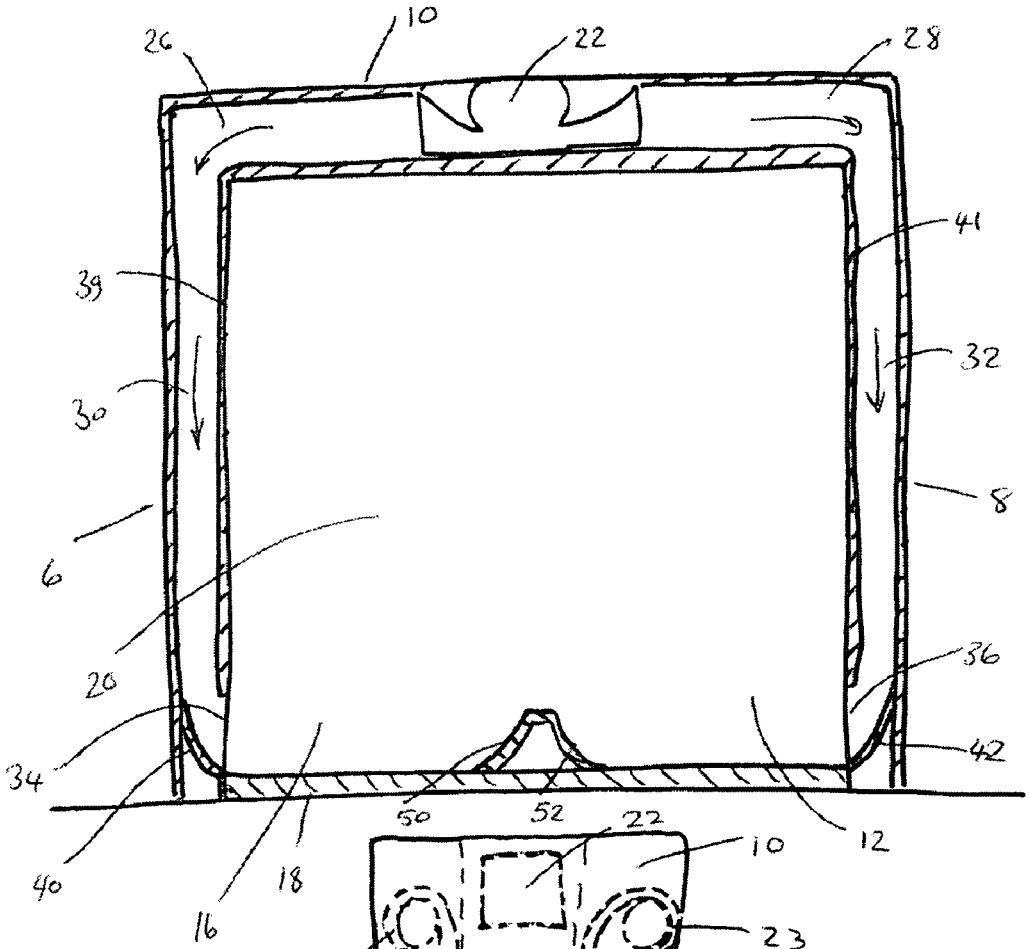
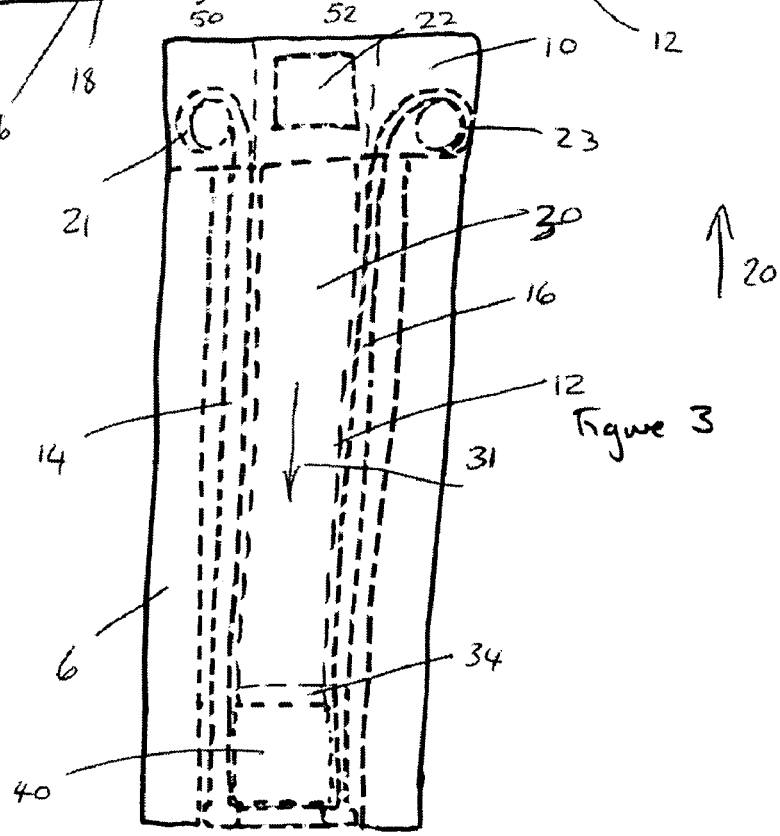
Figure 3

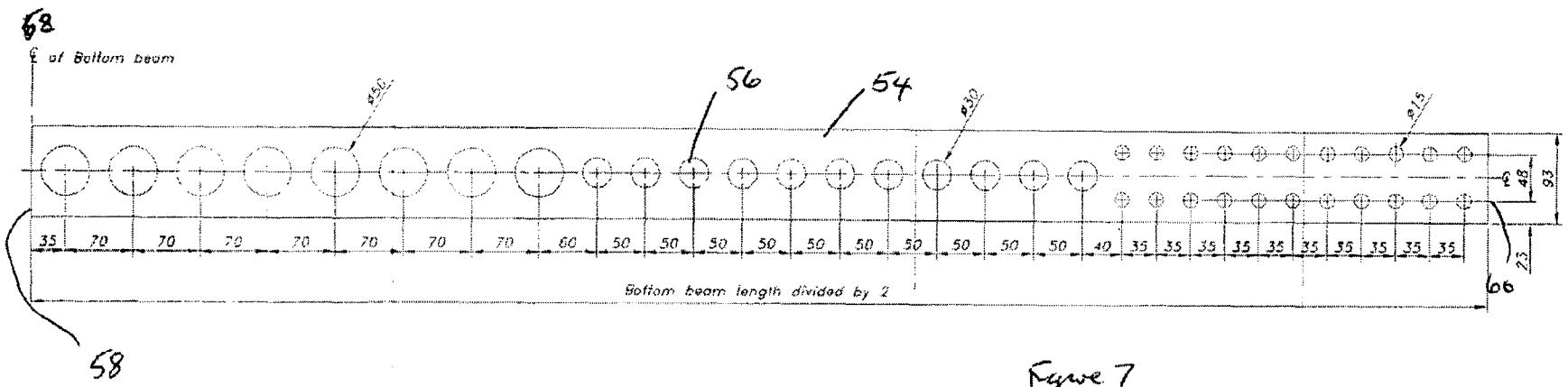

Figure 7

IN-HOUSE NOTE:
2 off Ethafoam bottom beam inserts to be made as shown using the nearest punch size shown to cover a Bottom beam length of ----mm long.

INSTALLATION NOTE:
Insert Ethafoam Air Deflection into the the bottom beam between the two uprights as shown.
Adjust the Air Deflector by inserting with the large holes in the centre or the small holes in the centre of the blade to suit the air flow round the door and record which senario you have used.

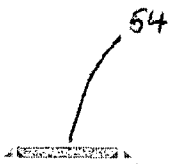

1/18

Figure 8

DOOR CLOSURE SYSTEM

CROSS-REFERENCE TO RELATED APPLICATION

This application claims priority to United Kingdom Application No. 0509919.7 filed on May 16, 2005 by inventors Christine Isobel Schofield and Peter James Howard Rodgers.

FIELD OF INVENTION

The invention to which this application relates is to improvements to a door closure system of the type which is particularly, although not necessarily exclusively, of use to be movable between an open and closed position with respect to an environment, on one side, which is held in chilled or freezing temperatures for the storage of goods therein and, on the other side an environment which is substantially at ambient temperature.

BACKGROUND OF INVENTION

A problem which is often experienced with openings between environments which are required to be held at different temperatures, is the need to provide a closure in the form of a door for the opening, which door is operable to move between opened and closed positions and in particular, once opened, to return to a closed condition as quickly as possible so as to be able to maintain the temperature in the cooler environment and thereby allow the maintenance of the goods in the cooler environment at the required temperature.

The applicant, in their co-pending application GB2385659, disclose such a door system which incorporates a first wall or curtain which forms an external surface facing into one of the environments and a second, opposing, spaced, wall or curtain which forms the external surface facing into the second environment.

A further problem which is experienced is the creation of condensation on the door itself which can lead to, firstly, the gathering of water or liquid in the vicinity of the door and, if frost forms, the malfunction or poor operation of the door structure.

The applicant's co-pending application discloses the ability to pump air, which is required to have a relatively low humidity, through the cavity defined between the first and second walls of the door and said air, which may also be heated but need not necessarily be so, serves to reduce the tendency of moisture or frost being created on the door.

SUMMARY OF INVENTION

The aim of the present invention is to ensure that the air is uniformly passed through said cavity and to provide an airflow system and a structure whereby this problem is overcome.

In a first aspect of the invention, there is provided a door structure, said door structure including a door selectively movable between open and closed conditions, a frame formed from spaced side members and a top member which, in combination with the floor, define the opening in which the door is positioned, the door when closed, formed by a first wall forming an external surface at a first side of the opening and a second, spaced wall defining an external surface to the second side of the opening, said first and second walls defining a cavity between the same which extends substantially across the area of the opening and air movement means are provided to cause the movement of air into and through the said cavity and wherein the air is introduced into the cavity from a port located on one of the side members of the door frame and towards the lower edge of the door when the door is closed.

Preferably an opening is provided in each side frame member so that air is introduced into the door cavity from each side member and further preferably, the ports are located so that air enters the cavity at or adjacent to the lowest edge thereof.

In one embodiment the lower edge of the door joins the first and second wall and is formed by a plate. In one embodiment the plate can be a flexible membrane.

In one embodiment a perforated layer is provided adjacent the lower edge of the door, spaced inwardly from said plate such that said layer and lower edge plate form a channel into which air passes from the side member ports rather than directly into the cavity. The air then passes into the remainder of the cavity by passing through the perforated layer apertures. In one embodiment the size of the apertures increases from the edges of the layer towards the middle of the same.

In one embodiment the configuration of the apertures also changes.

In one embodiment the perforated layer is formed of foam.

In one embodiment, deflector plates or vanes are located in the side frame members adjacent the ports so as to induce the entry of air into the cavity in a preferred flow path.

In one embodiment, the cavity includes plates or vanes mounted therein to further control the movement of air through the cavity and, in one embodiment, plates or vanes are provided towards the lowest edge of the cavity, depending into the cavity and at a location centrally of said lower edge.

In a further embodiment, adjustment means are provided along the flow channels to allow "fine tuning" of the flow to suit particular environments and/or dimensions of the door. The adjustment means can be any, or any combination of, flaps, valves or the like.

Typically, the air movement means is a pump which is located in the door frame or above the same such that the air from the air movement means passes along channels provided in the said door flame top and side members to reach the ports into the cavity.

Typically the air is checked with respect to predetermined parameters with regard to the humidity of the same and, if necessary, can be conditioned to "dry" the same prior to entering the door cavity. In one embodiment heaters are also provided, typically in the door frame to heat the air prior to it entering the door cavity.

Typically, the door is movable between open and closed conditions by raising and lowering the same respectively with regard to the door frame.

This movement can be achieved quickly and efficiently in accordance with the applicant's co-pending patent application and thereby ensures that the environments on each side of the door are exposed to each other through the opening for a minimum period of time.

In one embodiment the temperature of the environment on one side of the door is lower than the temperature of the environment on the opposing side of the door and the door is provided to maintain the differential in temperature. In one embodiment the environment in which the temperature is lower is a chilled or frozen storage facility.

It is found by controlling the flow of air through the cavity in the door as herein described, so the air is found to act more substantially uniformly across the area of the walls of the door and thereby further minimising or indeed eliminating the creation of frost on the walls or in the vicinity thereof.

In a further aspect of the invention there is provided a door, said door formed from first and second walls held in a spaced configuration so as to define a cavity therebetween, said walls formed of a flexible material to allow the same to be selectively rolled and unrolled to move the door between open and closed conditions, said door having a lower edge formed by a plate joining the lower edges of the first and second walls and wherein spaced inwardly of the plate there is provided a perforated or porous layer, said layer and plate forming a channel or passage into which a fluid is supplied prior to passing through the perforated or porous layer and into the cavity.

In one embodiment the perforated or porous layer includes a series of apertures formed therein to allow the passage of the fluid from the channel or passage and into the cavity. Typically the apertures increase in size from opposing edges of the layer towards the middle axis of the layer said edges and middle axis being perpendicular to the longitudinal axis of the layer.

BRIEF DESCRIPTION OF DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following descriptions taken in conjunction with the accompanying drawings, in which:

FIG. 1 illustrates an elevation of a door structure in accordance with the invention;

FIG. 2 illustrates the elevation of FIG. 1 with portions of the structure removed for ease of reference;

FIG. 3 illustrates a cross sectional elevation through the door structure;

FIGS. 6-8 illustrate embodiments of the perforated layers to be positioned towards the lower edge of the door.

DETAILED DESCRIPTION OF THE INVENTION

Figure 4:
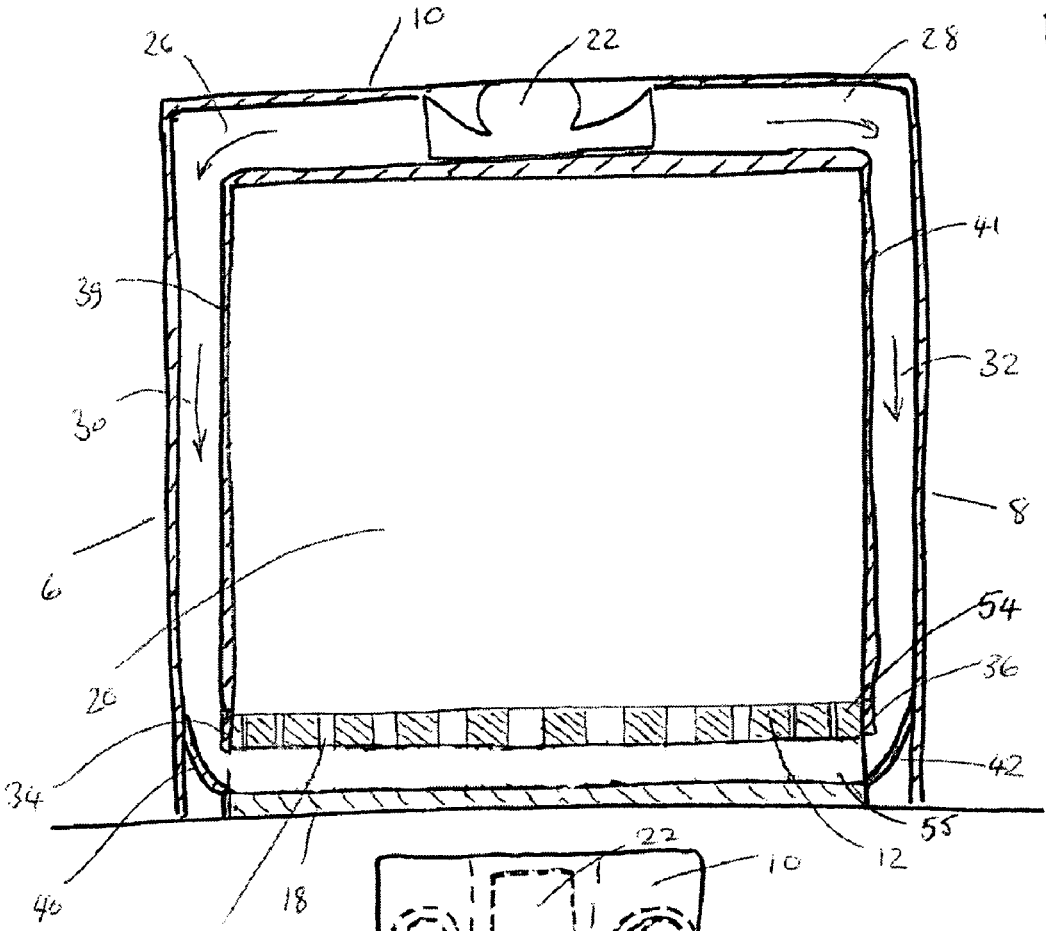
FIGS. 4-5 illustrate a further embodiment of the invention with portions of the structure removed for ease of reference.

Referring now to the drawings, there is illustrated a door structure in accordance with one embodiment of the invention. The door structure 2 comprises a door frame 4 formed of side members 6, 8 and top member 10 which in conjunction with the floor on which the frame is mounted define an opening in which the door 12 is provided. The door 12 is formed by a first wall 14 and a spaced, second wall 16 which together, in conjunction with a bottom beam or layer 18 form a cavity 30. The door structure is shown in a closed condition but can be moved to an open condition by a mechanical drive means of rollers 21, 23 to move the door in direction 20 whereupon the walls of the door, which are flexible to a degree, can be wound and stored at or above the top door frame member 10 in a rolled up form on respective rollers 21, 23. In the open position, persons and/or objects can be moved between the environments on either side of the door and it is found that doors of this type are of particular advantage when one of the environments is a chilled or frozen storage facility. To unroll the walls to again close the door, the drive of the rollers can be reversed which causes each of the walls to unroll from the respective roller such that the leading or bottom edge beam or layer 18 of the walls moves down towards the floor. Preferably, and especially where the environment on at least one side of the door is a chilled or frozen environment, the time during which the door is open is kept to a minimum to ensure that the chilled temperature is kept as low as is required and warmer air passing from the other side of the door is kept to a minimum. Because of the speed of the movement of the door from closed to open and back to a closed condition, sensors can be provided on or adjacent to the door to detect the presence of a person, object or vehicle in the door opening. If a detection is made then the door is prevented from moving back down to the closed position until the detected person or object leaves the door opening and it is then safe for the door to be moved back to the closed position.

The structure further includes air movement means 22 which typically can be in the form of a pump and the air movement means may also include means to allow "dry" or low humidity air to be created and then moved through the door structure and into the door cavity particularly when the door is in the closed position. In one embodiment, heating means can also be provided to heat the air which is to be moved through the structure.

The movement of the air is illustrated in detail in FIG. 2 which shows the door frame in section and the wall 14 removed. It is shown that the air which leaves the air movement means 22 passes in two paths 26, 28 through channels or ducts formed in the side door frame members as indicated by arrows 31, 32 such that the air passes down and along the side frame members until it reaches ports 34, 36 in the respective side frame members. It should also be appreciated that the side walls of the cavity are in fact formed by the inner facing surfaces 39, 41 of the side frame members with which the side edges of the walls locate.

In the channels in the side wall members, there are provided deflection plates 40, 42 which are shaped so as to induce the flow of the air in a desired manner and such that the air enters the cavity 30 in the door in a desired manner and with a reduction in turbulence as the aim is to ensure that the air passes uniformly across the cavity. Once the air has entered the cavity 30 then the same begins to move through the cavity and further deflector plates 50, 52 are located within the cavity and depend upwardly from the bottom edge of the cavity at a central location on said bottom beam 18 so as to further induce the movement of the air upwardly and uniformly through the cavity.

Figure 5:
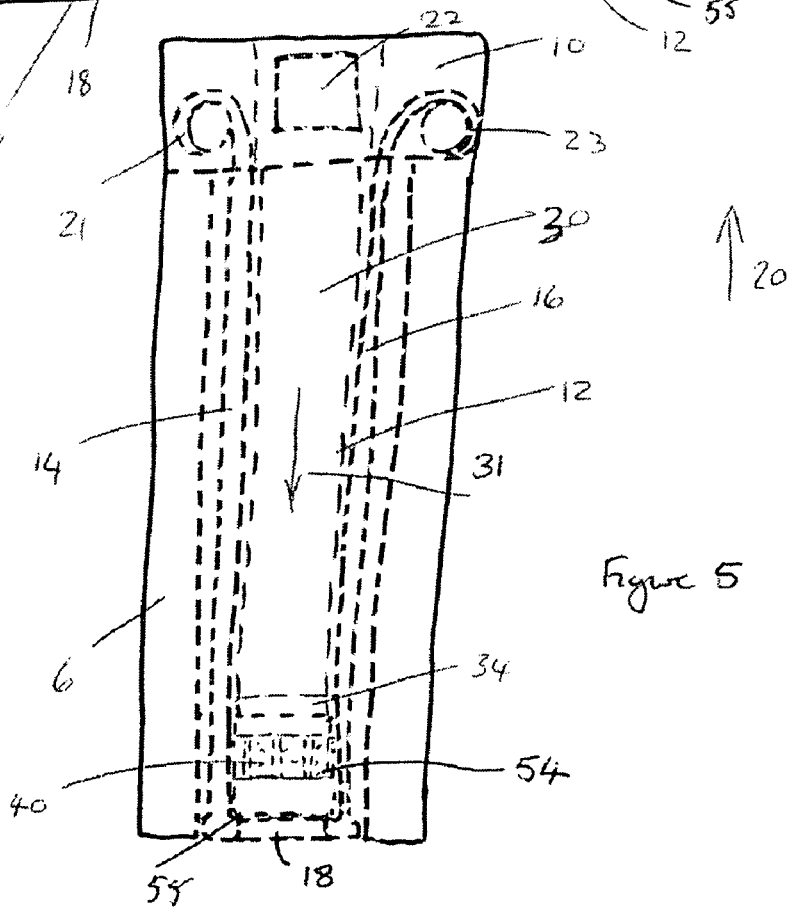

Referring now to FIGS. 4 and 5, there is illustrated a further embodiment of the invention in which the same reference numerals are used for common features. In this embodiment the bottom beam or plate 18 of the cavity has a layer of perforated or porous material 54, offset therefrom to form a channel 55 into which air enters from the side members through ports 34, 36 and the layer 54 forms the internal surface facing towards the cavity. One suitable material is a unicellular foam layer placed above the bottom beam or plate 18.

In one embodiment, as shown in FIG. 6, the material is provided with holes 56, which increase in size towards the middle axis 58 of the layer of the beam. In practise, this layer 54 is found to improve the subsequent dispersion of air within the cavity 20 from the deflector plates 40. 42 and distribute the air more evenly upwardly and across the whole width of the cavity. If required the vanes 50, 52 can still be provided in the channel 55, although not shown in this example.

FIGS. 7 and 8 illustrate a variation in the configuration of the apertures 56 and in this case, only one half of the layer 54 is shown with the edge 58 to be located at the centre of the cavity where the apertures 56 are to be at their longest and the edges 60 located adjacent one edge of the cavity where the apertures are at their smallest. Two of the layers in reverse configuration will therefore be fitted end to end across the cavity of the door. FIG. 8 illustrates the layer 54 fitted in position in end elevation.

By providing the layer 54 with the apertures configured as illustrated so the reduction in air flow which typically occurs towards the centre line 58 of the cavity can be offset as the apertures 56 are larger than at the edge of the cavity thereby allowing more air flow through and the smaller apertures at the edge prevent greater air flow and cause more of the air to pass to the centre.

In whichever embodiment the air will over time, escape from the cavity, as the cavity is not necessarily airtight and so the continual flow of the dry air is required when the door is in the closed position shown. The flow of this dry and possibly heated air is found to reduce the condensation effect across the door structure substantially uniformly and hence prevents or minimise the creation of frost at cold spots if, for example, the door structure is used to selectively close an opening between a chilled or frozen temperature environment on one side of the opening and door and an ambient environment on the other side of the opening and door.

What is claimed is:

1. A door structure, said door structure comprising a door selectively movable between open and closed conditions; a frame formed from spaced side members; and a top member which, in combination with the floor, define the opening in which the door is positioned, the door when closed, formed by a first wall forming an external surface at a first side of the opening and a second, spaced wall defining an external surface to the second side of the opening, said first and second walls defining a cavity between the same which extends substantially across the area of the opening and air movement means are provided to cause the movement of air into and through the said cavity and wherein the air is introduced into the cavity from a port located on one of the side members of the door frame and towards the lower edge of the door when the door is closed, wherein the lower edges of the first and second walls are joined by a plate, and wherein a perforated layer of material is provided adjacent the lower edge of the door, said layer and plate forming a channel into which air passes from the side member ports and then passes through the perforated layer apertures.

2. A door structure according to claim 1 wherein a port is provided in each of the side members of the frame so that air is introduced into the door cavity from each side member.

3. A door structure according to claim 2 wherein the ports are located so that air enters into the cavity at or adjacent to the lowest edge thereof.

4. A door structure according to claim 1 wherein the size of the apertures increases progressively from the opposing edges of the layer towards the middle axis of the layer, said edges and middle axis being perpendicular to the longitudinal axis of the layer.

5. A door structure according to claim 1 wherein the perforated layer is formed of foam.

6. A door structure according to claim 1 wherein deflecting plates or vanes are located in the side frame members adjacent the openings so as to induce the entry of air into the cavity in a preferred flow path.

7. A door structure according to claim 1 wherein the cavity includes plates or vanes mounted therein to control the movement of air through the cavity.

8. A door structure according to claim 7 wherein the plates or vanes are provided towards the lowest edge of the cavity depending into the cavity and at locations centrally of said lower edge.

9. A door structure according to claim 1 wherein the air movement means is a pump located above the door cavity such that air from the air movement means passes along the flow channels provided in the said door frame to reach the openings into the cavity.

10. A door structure as in any of the preceding claims wherein the air is conditioned such that the same is dehumidified and/or heated to meet predetermined parameters prior to entering the openings into the cavity.

11. A door structure according to claim 1 wherein the door is movable between open and closed positions by raising and lowering the same respectively with regard to the door frame.

12. A door structure according to claim 1 wherein the temperature of the environment on one side of the door is lower than the temperature of the environment on the opposing side of the door and the door is provided to maintain the differential in temperature.

13. A door structure according to claim 12 wherein the environment in which the temperature is lower is a chilled or frozen storage facility.

* * * * *